US005200097A

United States Patent [19]

Hughes et al.

[11] Patent Number: 5,200,097

[45] Date of Patent: Apr. 6, 1993

[54] PROCESS FOR MAKING A PARTICULATE WATER DISPERSIBLE FREE FLOWING FABRIC SOFTENER COMPOSITION

[75] Inventors: Leonard Hughes; James G. Fuller, both of Dublin, Ohio; William J. Zeman, Janesville, Wis.

[73] Assignee: Sherex Chemical Company, Inc., Dublin, Ohio

[21] Appl. No.: 512,887

[22] Filed: Apr. 23, 1990

Related U.S. Application Data

[63] Continuation-in-part of Ser. No. 354,476, May 19, 1989, abandoned, which is a continuation-in-part of Ser. No. 233,340, May 31, 1988, abandoned.

[51] Int. Cl.[5] ..... C11D 3/42

[52] U.S. Cl. ..... 252/8.75; 252/8.8

[58] Field of Search ..... 252/8.8, 8.9, 8.75; 564/291, 295

[56] References Cited

U.S. PATENT DOCUMENTS

| | | | |
|---|---|---|---|
| 3,492,324 | 1/1970 | Blackman | 260/404.5 |
| 3,933,871 | 1/1976 | Armstrong | 260/401 |
| 4,102,795 | 7/1978 | Minegishi | 252/8.8 |
| 4,115,281 | 9/1978 | Ciko et al. | 252/8.8 |
| 4,155,710 | 5/1979 | Komninos et al. | 8/74 |
| 4,239,631 | 12/1980 | Brown | 252/8.75 |
| 4,399,045 | 8/1983 | Burns | 252/8.75 |
| 4,439,335 | 3/1984 | Burns | 252/8.75 |
| 4,497,716 | 2/1985 | Tai | 252/8.8 |
| 4,906,410 | 6/1990 | Lacke et al. | 252/8.8 |

FOREIGN PATENT DOCUMENTS 112719 4/1984 European Pat. Off. .

*Primary Examiner*—Prince Willis, Jr.
*Assistant Examiner*—John F. McNally
*Attorney, Agent, or Firm*—Scully, Scott, Murphy & Presser

[57] ABSTRACT

The addition of up to 15 percent by weight of a polyoxyalkylene derivative to a fatty acid derived bis(alkylamidoalkyl)amine derived quaternary salt permits the atomization of the latter in conventional equipment. The resulting fabric softening product is in the desirable form of a free flowing solid, water dispersible powder.

13 Claims, No Drawings

PROCESS FOR MAKING A PARTICULATE WATER DISPERSIBLE FREE FLOWING FABRIC SOFTENER COMPOSITION

CROSS-REFERENCE TO RELATED APPLICATION

This application is a continuation-in-part of application Ser. No. 354,476 filed May 19, 1989 now abandoned which is a continuation-in-part of application Ser. No. 233,340 filed May 31, 1988, which is based on PCT/US86/01582 having international filing date of Aug. 4, 1986.

BACKGROUND OF INVENTION

1. Field of Invention

This invention relates to water dispersible, free flowing solid softening compositions for textiles and textile fibers, and a process for their manufacture.

2. Description of the Related Art

The tendency for laundered textile fibers to acquire rigidity and static charges is most pronounced when the laundry product is a synthetic detergent. Stiffness of the fibers and static charges combine to impart a palpable harshness to the textile. Articles of clothing, bed linens and the like, possessing such harshness, are irritating to the skin and uncomfortable to wear. In addition, they tend to retain wrinkles and attract dirt and dust. These undesirable consequences of laundering have been overcome by the use of quaternary ammonium compounds, among others. Quaternary ammonium compounds are currently widely used to impart softness and pliability to the textile and to diminish static charges. Quaternary compound softeners may be a component of the laundry detergent, may be added separately to the wash water at some point in the laundry cycle, or dispensed in the dryer.

The utility of quaternary salts of bis(alkylamidoalkyl)amine, especially those derived from fatty acids, as softeners for textile fibers in laundry applications, and a method for their preparation, are set forth in U.S. Pat. No. 3,492,324. This patent teaches that the quaternary compounds are obtained as semi-solids or solids, which are admixed with appropriate quantities of water to form pastes. These pastes, which are "pourable", may then further be admixed with water to form dispersions suitable for incorporation onto textiles or textile fibers for the purpose of softening them.

Aqueous pastes are by their nature incapable of being incorporated into powdered laundry products, without deleteriously affecting the free flowing characteristics of such products. Further, aqueous pastes or dispersions suffer from handling, storing, packaging, and shipping disadvantages.

Problems inherent in the use of such aqueous systems include: storage instability due to changes in temperature, which result in the separation of the quaternary compound from the water; loss of water due to evaporation, which alters the concentration of softener in the mixture and results in non-uniform application of the softener. In order for formulators to use the paste itself, it must be removed from the container and dispersed with sufficient water to obtain a softening dispersion. Bulk dispensing of a paste under these circumstances is physically difficult, and results in losses of paste itself and inaccurate dispensing of softening material.

An alternative to the paste form of bis(alkylamidoalkyl)amine-derived quaternary fabric softening compounds is as an aqueous dispersion. Such aqueous dispersions suffer from the inherent problems of aqueous pastes, and in addition, require the use of bulkier rigid metal or plastic shipping containers, which increases the cost of storage and transportation.

It is also known in the art that the dispersibility in water of such quaternary fabric softening compounds, and the stability of aqueous dispersions thereof, may be enhanced by the addition of fatty alcohols, e.g., U.S. Pat. No. 4,102,795.

The literature does not reveal the use of bis(alkylamidoalkyl)amine-derived quaternary fabric softeners in particulate or powder form. The physical properties of these quaternary compounds e.g.; high viscosity in the molten state; melting range, on the order of 100° C; and a decomposition temperature of about 120° C; are not conducive to preparation of particulates or powders. We have, however, discovered a convenient method for the preparation of bis(alkylamidoethyl)amine-derived quaternary fabric softening compounds in the form of particulates or powders.

SUMMARY OF THE INVENTION

The present invention is directed to a particulate, water dispersible, free flowing fabric softener composition. Such a composition may be obtained by admixing an effective quantity of a processing aid, such as a polyoxyalkylene derivative, with a bis(alkylamidoalkyl)amine-derived quaternary compound, melting them, and atomizing the molten mixture in conventional equipment appropriate for obtaining particulate material from a molten mixture. The particulate product obtained permits the use of bis(alkylamidoalkyl)amine-derived quaternary fabric softening compound in solid laundry products without altering their free flowing characteristics. Being a solid, the particulate product does not suffer from the physical handling drawbacks associated with pastes of bis(alkylamidoalkyl)amine-derived quaternary compounds, while at the same time, being easily dispersed in water.

DETAILED DESCRIPTION OF THE INVENTION

This invention relates to bis(alkylamidoalkyl)amine-derived quaternary fabric softening compositions in the form of free flowing, water dispersible particulates or powders. The art in the field of bis(alkylamidoalkyl)amine-derived quaternary compounds which function well as fabric softeners is directed to non-powders, i.e., aqueous pastes or dispersions. The physical properties of these quaternary compounds are conducive to their preparation as aqueous pastes or dispersions and they are marketed and shipped to formulators in these forms.

The process for the manufacture of the bis(alkylamidoalkyl)amine-derived quaternary fabric softening compounds of this invention is taught e.g., by U.S. Pat. No. 3,492,324. Thus fatty acids are reacted with diethylenetriamine in a mole ratio of 2:1. The resulting bis(alkylamidoethyl)amine is methylated by reaction with formic acid and/or formaldehyde, and the resulting bisalkylamidoethyl)methyl amine is quaternized with conventional reagents, e.g., dimethyl sulfate.

It is also well known in the art relating to the quaternization of amines that benzyl chloride, methyl chloride and dimethylsulfate are suitable quaternizing agents for tertiary amines, such as the bis(alkylamidoethyl)methyl amine described above. Further, it is also well known in the art that methyl chloride may be reacted with secondary amines such as the bis(alkylamidoethyl)amine described above, in a mole ratio of 2:1 respectively, to produce a quaternary compound useful for fabric softening.

In order for quaternary compounds to be more widely useful as fabric softeners, especially in free flowing laundry detergent compositions, and to overcome the problems inherent in shipment, storage and use as aqueous pastes and dispersions, a particulate form of the quaternary compound is desirable. Conventional atomizing equipment to produce such particulates includes spray drying, spray congealing, and prilling devices among others. Spray drying and spray congealing, for example, necessitate pumping liquified quaternary compounds through narrow orifices under sufficient pressure to produce fine droplets.

The viscosity of molten bis(alkylamidoalkyl)amine-derived quaternary compound is such that it is incapable of being pumped neat at the maximum allowable temperature, i.e., the temperature of incipient decomposition. That is, at the maximum permissible temperature, the viscosity of the bis(alkylamidoalkyl)amine-derived quaternary compound itself exceeds the physical limitations of conventional pumps, within the limits of economic practicality. Thus the pump cavitates or otherwise fails to transfer the molten material from the input reservoir to the output. This condition is exacerbated when the output is a narrow constriction or orifice, as is the case in conventional atomization equipment.

Conventional atomization equipment includes devices such as spray nozzles, rotating disks, or shot towers. Some of these devices function by forcing a liquid through narrow orifices to produce fine droplets. The droplets solidify to form the particulate. Cooling, e.g., by means of refrigerated air or other gasses, may be provided to aid solidification of said droplets. The range of particles in the particulate thus produced is nominally from 10 to 900 microns in diameter, with the preferred range for the use of this invention averaging from 100 to 300 microns in diameter. The orifice sizes necessary to produce this range of particulate will vary with the viscosity of the molten bis(alkylamidoalkyl)amine-derived quaternary compound, the type of atomization, and the characteristics of the ancillary equipment used to force the liquified quaternary compound through those orifices.

The orifice sizes may range from about 0.1 to 5 millimeters in diameter.

The force necessary to atomize a liquid, by whatever means, may be supplied by mechanical pumps or by centripetal force, as is the case of spinning disks. Thus, fatty acid derived quaternary compounds, which are ordinarily solids at room temperature, must be liquified to utilize atomization equipment and thus form a particulate.

Liquification of bis(alkylamidoalkyl)amine-derived quaternary compounds based on fatty acid may be accomplished by heating to 100 to 120° C. Higher temperatures usually result in degradation of the product as evidenced by discoloration or browning.

At approximately 120° C., the viscosity, i.e, the ability to pass through an orifice, of bis(hard tallowamidoethyl)dimethyl ammonium quaternaries is extremely high, and has been measured at over 160,000 centipoises. This viscosity is such as to incapacitate conventional mechanical pumps, within the limits of economic practicality, necessary to the atomization process, as has been described in the foregoing. Attempts to reduce viscosity by means of increasing the temperature results in decomposition of the quaternary compound itself. Of course, water could be added to dilute the molten mass, and thus reduce the viscosity. However, additional water sufficient to facilitate pumping results in products with unacceptably high water content. Such high water content causes the powder particles to agglomerate resulting in solids which are no longer free flowing, and which on standing tend to form solid masses This tendency of a powder to form solid masses is characterized as "tack". Tack may be evaluated by determining the force, in pounds, necessary to break a formed cake of the respective material. The cake is formed by compacting 450 ml of product in a circular mold, 8.57 cm in diameter and 12.7 cm high, with a 9.98 kg piston, at room temperature for 2 minutes.

Solvents other than water, for example isopropyl alcohol, may be added to reduce the viscosity of the molten quaternary compound. Sufficient quantities of isopropyl alcohol to facilitate pumping also result in unacceptably high levels of "tack". Further, isopropyl alcohol, being flammable, presents additional problems in commercial scale equipment. There is an inherent explosion hazard, and the vaporized isopropyl alcohol must be recovered from the vapor state in an environmentally acceptable manner. The equipment required to accomplish this recovery, i.e., by condensation, is both costly and cumbersome.

It has been discovered that by incorporating an effective amount of a polyoxyalkylene derivative processing aid, into molten bis(alkylamidoalkyl)amine-derived quaternary compounds, a particulate, free flowing water dispersible fabric softener composition may be obtained by conventional atomization techniques. The addition of polyoxyalkylene derivatives significantly reduces the viscosity of the molten quaternary compound, facilitating atomization with conventional equipment, while not decreasing the free flowing characteristics or the dispersibility of the resultant particulate.

This is evidenced by little significant change in either "tack" or dispersibility, when the polyoxyalkylene processing aid is incorporated into the bis(alkylamidoalkyl) amine-derived quaternary compound.

The particulate, water dispersible, free flowing fabric softener composition of the present invention comprises a bis(alkylamidoalkyl)amine-derived quaternary compound having the structural formula:

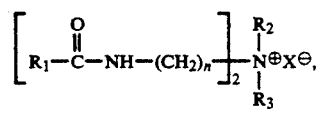

(I)

where:

$R_1$ is a $C_6$–$C_{22}$ alkyl group $R_2$ is a $C_1$–$C_3$ alkyl group $R_3$ is a $C_1$–$C_3$ alkyl group, a phenyl group or a benzyl group n is 1–6

$X^-$ is a monovalent anionic residue of an alkylating agent.

In a preferred embodiment the quaternary compound is characterized by $R_1$ being $C_{13}$–$C_{21}$ alkyl and X being a methosulfate or chloride radical. More preferably, the quaternary compound is defined by $R_1$ being $C_{15}$–$C_{17}$ and X being a methosulfate or chloride radical.

The free flowing fabric softener composition additionally includes a polyoxyalkylene derivative useful as a processing aid in the preferred concentration ranges recited above. The polyoxyalkylene derivative processing aid is a compound having the structural formula:

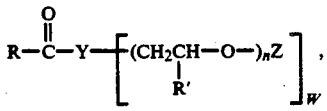

(II)

a compound having repeating structural formula

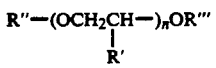

(III)

or mixtures thereof wherein:
n is an integer of 0 to 30;
R is a $C_6$ to $C_{22}$ alkyl group;
R′ is hydrogen or a $C_1$–$C_3$ alkyl group;
R″ is hydrogen, $C_5$–$C_{22}$ alkyl, or isostearyl;
R‴ is hydrogen, $C_5$–$C_{22}$ alkyl or isostearyl;
Y is oxygen or

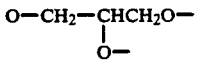

W=1 or 2;
Z is hydrogen or a substituent of the formula:

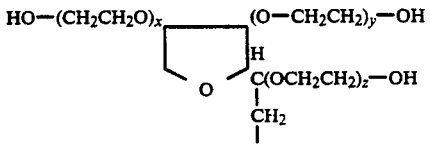

where x, y and z are independently integers of 2 to 10. A preferred class of polyoxyalkylene compounds are those characterized by mixture of compounds having the structural formula II where R′ is hydrogen and methyl groups.

In a preferred embodiment the polyoxyalkylene derivative is the reaction product of up to 30 moles of ethylene oxide with the monoglyceryl ester of coconut fatty acid. More preferably, the reaction product of approximately 30 moles of ethylene oxide and 1 mole of the monoglyceryl ester of a coconut fatty acid is employed as the processing aid.

Other preferred embodiments of the polyalkylene derivative processing aid, within the broad classes mentioned above, that can be used include ethoxylated sorbitan oleate derivatives and ethoxylated fatty alcohols.

Thus, in another preferred embodiment, the polyoxyalkylene derivative processing aid is the adduct of 20 moles of ethylene oxide and sorbitan monooleate. In another embodiment, the processing aid is the adduct of 20 moles of ethylene oxide and isostearyl alcohol.

The amount of polyoxyalkylene derivative utilized is that amount effective as a processing aid. That amount is usually up to about 15% by weight of the bis(alkylamidoalkyl)amine-derived quaternary compound. Preferably, about 2% to about 15% by weight of the polyalkylene derivative, based on the weight of the quaternary compound, is utilized. Less than 2% by weight tends to be ineffective in reducing viscosity. More than 15% by weight of the polyalkylene derivative, based on the weight of the bis(alkylamidoalkyl)amine-derived quaternary compound, tends to increase the "tack" of the particulate. More preferably, about 2% to about 12% by weight of the polyalkylene derivative, based on the weight of the quaternary compound, is employed. More preferably, 10% by weight of the polyalkylene derivative is used.

The preferred fatty acid derived bis(alkylamidoalkyl)amine-derived quaternary compound is that derived from hardened tallow fatty acids as in Example 1 below.

Another aspect of the present invention involves a process for making a bis(alkylamidoalkyl)amine-derived quaternary compound fabric softener in particulate form.

In this process a liquified blend of the bisalkylamidoalkyl)amine-derived quaternary compound having the structural formula I where the radicals have the meanings given for the formula and a polyoxyalkylene derivative processing aid selected from the group consisting of compounds having the structural formula II, compounds having the structural formula III and mixtures thereof are formed. In the forming of this blend enough polyoxyalkylene derivative is included to insure pumpability of the quaternary compound.

The process includes the further step of atomizing the liquified blend to form particulates.

To illustrate the efficacy of this invention, the following non-limiting examples are set forth.

EXAMPLE 1

Bis(hard tallowamidoethyl)dimethyl ammonium methosulfate prepared from hardened tallow fatty acids, following the teachings of U.S. Pat. No. 3,492,324, was melted at 110° C. and atomized through a nozzle having an orifice 1.2 mm in diameter at a pressure of 2000 psi. Only a small quantity of particulate was obtained before pumps and lines became plugged, rendering the equipment inoperable. Residual isopropanol from preparation of the quaternary compound was removed by vacuum drying at 40° C.

EXAMPLE 2

To 90 parts of the quaternary compound of Example 1 were added 10 parts of the adduct of 30 moles of ethylene oxide and glycerol mono cocoate, {Varonic LI-63, Sherex Chemical Company, Dublin, OH). The mixture was melted at 110° C. and atomized through the identical equipment and under the identical conditions of Example 1. The atomized droplets were congealed, in air, at a temperature of 15 to 21° C. and a relative humidity of 50%. The congealed particulate having a particle size range averaging from 100 to 300 microns in diameter was subsequently vacuum dried as in Example 1.

EXAMPLE 3

To 90 parts of the quaternary compound of the Example 1 were added 10 parts of isopropyl alcohol and 10 parts of ethoxylated sorbitan mono oleate, (Tween 80, ICI Americas, Wilmington, DL: 20 moles of ethylene oxide per mole of sorbitan mono oleate). The mixture was melted at 110° C., and atomized, congealed and vacuum dried as in Example 1.

EXAMPLE 4

90 parts of the quaternary compound of Example 1 were admixed with 10 parts of ethoxylated isostearyl alcohols (Arosurf 66E-20, Sherex Chemical Company, Dublin, OH 20 moles of ethylene oxide per mole of isostearyl alcohol), and 10 parts of isopropyl alcohol. The mixture was melted at 110° C., atomized, congealed and dried as in Example 1.

Viscosity

The viscosities of the particulates obtained by atomization of Examples 1 to Example 4 were determined on a Brookfield Viscometer (Thermosel) using a #34 spindle (Brookfield Engineering Laboratories, Inc. Staughton, MA). These data are presented in Table 1:

TABLE 1

| Product of Example | Temperature °C[1] | Viscosity (CPS) |
|---|---|---|
| 1 | 120 | 160,000 |
| 2 | 120 | 735 |
| 3 | 120 | 260 |
| 4 | 120 | 170 |

[1]Temperature of melted quaternary compound (and processing aid).

It can be observed from these data that a reduction of viscosity of at least 200 fold is obtained by the use of processing aids. Example 1, without processing aid, overwhelmed the physical capability of the spray congealing equipment (See Example 1).

Dispersibility

The dispersibility in water of particulates of Examples 1 to 4 were determined by visual inspection of a mixture of 0.3 grams of product in 100 grams of water, after agitation at 32° C. for 10 minutes. The results are presented in Table 2:

TABLE 2

| Product of Example | Dispersibility |
|---|---|
| 1 | [1]unacceptable (not dispersed) |
| 2 | [2]acceptable (dispersed) |
| 3 | acceptable (dispersed) |
| 4 | acceptable (dispersed) |

[1]Unacceptable dispersions contain solid clumps and clear areas
[2]Acceptable dispersions are uniformly cloudy throughout The dispersibility of the particulate obtained by the use of a processing aid is significantly better than when no processing aid is present as in Example 1.

Tack

The "tack" of the particulate in Examples 1 to 4 was evaluated by determining the force in kilograms necessary to break a formed cake of the respective material. The cake is formed by compacting 450 ml of product in a circular mold 8.57 cm in diameter and 12.7 cm high, with a 9.98 kg piston, at room temperature for 2 minutes. The results are presented in Table 3.

TABLE 3

| Product of Example | Force in kg. necessary to Break Cake |
|---|---|
| 1 | 1.86 |
| 2 | 1.40 |
| 3 | 1.86 |
| 4 | 3.67 |
| 1* | 3.44 |

TABLE 3-continued

| Product of Example | Force in kg. necessary to Break Cake |
|---|---|
| 2* | >9.0 |

*Samples of product not vacuum dried at 40° C., i.e., containing ca. 5% by weight of isopropanol.

The presence of isopropanol significantly increases the "tack" i.e., reduces the ability of the particulate to flow freely while the preferred processing aids do not.

We claim:

1. A method for making bis(alkylamidoalkyl)amine-derived quaternary compound fabric softener in particulate form which comprises:

1) forming a liquified blend of:

(a) said bis(alkylamidoalkyl)amine-derived quaternary compound of the formula:

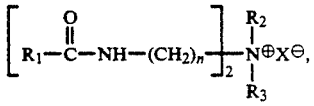

where:

$R_1$ is a $C_6$–$C_{22}$ alkyl group $R_2$ is a $C_1$–$C_3$ alkyl group $R_3$ is a $C_1$–$C_3$ alkyl group, a phenyl group or a benzyl group n is 1–6

$X^-$ is a monovalent anionic residue of an alkylating agent and, (b) a polyoxyalkylene derivative processing aid of a compound having the structural formula:

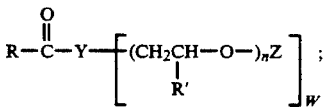

a compound having the structural formula:

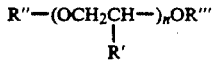

where:

n is 0–30

R is a $C_6$–$C_{22}$ alkyl group,

R′ is hydrogen or a $C_1$–$C_3$ alkyl group,

R″ is hydrogen, $C_5$–$C_{22}$ alkyl or isostearyl;

R‴ is hydrogen, $C_5$–$C_{22}$ alkyl or isostearyl;

W=1 or 2

Y is oxygen or a substituent of the formula:

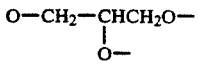

Z is hydrogen or a substituent of the formula:

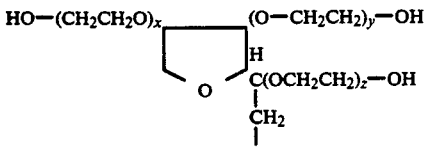

wherein x, y, and z may be from 1 to 10 and mixtures thereof; said processing aid present in an amount effective for quaternary compound to be pumpable (2) atomizing said liquified blend to form particulates thereof.

2. The process as in claim 1 where $R_1$ to $C_{13}$ to $C_{21}$ alkyl and $X^-$ is a methosulfate radical.

3. The process as in claim 1 where $R_1$ is $C_{13}$ to $C_{21}$ alkyl and $X^-$ is a chloride radical.

4. The process as in claim 2 where $R_1$ is $C_{15}$ to $C_{17}$ alkyl.

5. The process as in claim 3 where $R_1$ is $C_{15}$ to $C_{17}$ alkyl.

6. The process as in claim 2 where the polyoxyalkylene derivative processing aid is the adduct of 30 moles of ethylene oxide and coconut fatty monoglyceride esters.

7. The process as in claim 2 where the polyoxyalkylene derivative processing aid is the adduct of 20 moles of ethylene oxide and isostearyl alcohol.

8. The process as in claim 2 where the polyoxyalkylene derivative processing aid is the adduct of 20 moles of ethylene oxide and sorbitan monooleate.

9. The process as in claim 4 where the polyoxyalkylene derivative processing aid is the adduct of 30 moles of ethylene oxide and coconut fatty monoglyceride esters.

10. The process as in claim 4 where the polyoxyalkylene derivative processing aid is the adduct of 20 moles of ethylene oxide and isostearyl alcohol.

11. The process as in claim 4 where the polyoxyalkylene derivative processing aid is the adduct of 20 moles of ethylene oxide and sorbitan monooleate.

12. The process as in claim 4 where the polyoxyalkylene derivative processing aid is a mixture of polyoxyalkylene derivatives, where $R^1$ is hydrogen and methyl groups.

13. The process as in claim 6 where the polyoxyalkylene derivative processing aid is present in 10% by weight.

* * * * *

UNITED STATES PATENT AND TRADEMARK OFFICE

CERTIFICATE OF CORRECTION

PATENT NO. : 5,200,097

DATED : April 6, 1993

INVENTOR(S) : Leonard Hughes, et al.

It is certified that error appears in the above-identified patent and that said Letters Patent is hereby corrected as shown below:

Column 5, line 58: "monooleate" should read --mono oleate--

Column 6, line 17: "bisalk-" should read --bis(alky- --

Column 6, line 49: "ξ" should read --(--

Column 6, line 62: delete second occurrence of "the"

Column 9, line 12, Claim 1: after "for" insert --said--

Column 10, line 8, Claim 8: "monooleate" should read --mono oleate--

Column 10, line 18, Claim 11: "monooleate" should read --mono oleate--

Signed and Sealed this

Third Day of May, 1994

Bruce Lehman

*Attest:*

BRUCE LEHMAN

*Attesting Officer*

*Commissioner of Patents and Trademarks*